US008021107B2

(12) United States Patent
Espasa et al.

(10) Patent No.: US 8,021,107 B2
(45) Date of Patent: Sep. 20, 2011

(54) VARIABLE-NOZZLE ASSEMBLY FOR A TURBOCHARGER

(75) Inventors: Olivier Espasa, Dogenville (FR); Lorrain Sausse, Charmes (FR); Pierre Barthelet, Remiremont (FR); Francis Abel, Thaon les Vosges (FR)

(73) Assignee: Honeywell International Inc., Morristown, NJ (US)

( * ) Notice: Subject to any disclaimer, the term of this patent is extended or adjusted under 35 U.S.C. 154(b) by 1055 days.

(21) Appl. No.: 12/036,741

(22) Filed: Feb. 25, 2008

(65) Prior Publication Data

US 2009/0214330 A1 Aug. 27, 2009

(51) Int. Cl.
*F04D 29/46* (2006.01)

(52) U.S. Cl. ..... 415/160; 415/162

(58) Field of Classification Search ..... 415/155, 415/159, 160, 162, 163, 209.3
See application file for complete search history.

(56) References Cited

U.S. PATENT DOCUMENTS 7,303,370 B2 * 12/2007 Metz et al. ..... 415/150
7,507,067 B2 * 3/2009 Boening et al. ..... 415/150
7,670,107 B2 * 3/2010 Barthelet et al. ..... 415/160
7,918,023 B2 * 4/2011 Sausse et al. ..... 29/889.2
2006/0140751 A1 6/2006 Boening et al.
2008/0260520 A1 * 10/2008 Hettinger et al. ..... 415/163
2010/0260597 A1 * 10/2010 Sausse et al. ..... 415/160

* cited by examiner

*Primary Examiner* — Devon Kramer
*Assistant Examiner* — Jason Davis
(74) *Attorney, Agent, or Firm* — Alston & Bird LLP

(57) ABSTRACT

A variable-nozzle assembly comprises a nozzle ring and an array of vanes circumferentially spaced about the nozzle ring and rotatably mounted to the nozzle ring such that the vanes are variable in setting angle, and an insert having a tubular portion and an annular nozzle portion extending generally radially out from one end of the tubular portion. A plurality of axially extending holes extend through a thickness of the nozzle portion. A plurality of spacers have first ends joined to the nozzle ring, opposite second ends of the spacers being engaged in the holes and secured to the nozzle portion by welds formed at the second surface. An annular groove is defined in the second surface of the nozzle portion radially inward of and proximate to the holes. Alternatively or additionally, discrete recesses are formed in the second surface adjacent the holes. The groove and/or recesses facilitate weld penetration.

10 Claims, 5 Drawing Sheets

PRIOR ART

VARIABLE-NOZZLE ASSEMBLY FOR A TURBOCHARGER

BACKGROUND OF THE INVENTION

The present invention relates to turbochargers having a variable-nozzle turbine in which an array of movable vanes is disposed in the nozzle of the turbine for regulating exhaust gas flow into the turbine.

An exhaust gas-driven turbocharger is a device used in conjunction with an internal combustion engine for increasing the power output of the engine by compressing the air that is delivered to the air intake of the engine to be mixed with fuel and burned in the engine. A turbocharger comprises a compressor wheel mounted on one end of a shaft in a compressor housing and a turbine wheel mounted on the other end of the shaft in a turbine housing. Typically the turbine housing is formed separately from the compressor housing, and there is yet another center housing connected between the turbine and compressor housings for containing bearings for the shaft. The turbine housing defines a generally annular chamber that surrounds the turbine wheel and that receives exhaust gas from an engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

One of the challenges in boosting engine performance with a turbocharger is achieving a desired amount of engine power output throughout the entire operating range of the engine. It has been found that this objective is often not readily attainable with a fixed-geometry turbocharger, and hence variable-geometry turbochargers have been developed with the objective of providing a greater degree of control over the amount of boost provided by the turbocharger. One type of variable-geometry turbocharger is the variable-nozzle turbocharger (VNT), which includes an array of variable vanes in the turbine nozzle. The vanes are pivotally mounted in the nozzle and are connected to a mechanism that enables the setting angles of the vanes to be varied. Changing the setting angles of the vanes has the effect of changing the effective flow area in the turbine nozzle, and thus the flow of exhaust gas to the turbine wheel can be regulated by controlling the vane positions. In this manner, the power output of the turbine can be regulated, which allows engine power output to be controlled to a greater extent than is generally possible with a fixed-geometry turbocharger.

The variable vane mechanism is relatively complicated and thus presents a challenge in terms of assembly of the turbocharger. Furthermore, the mechanism is located between the turbine housing, which gets quite hot because of its exposure to exhaust gases, and the center housing, which is at a much lower temperature than the turbine housing. Accordingly, the variable vane mechanism is subject to thermal stresses because of this temperature gradient.

The assignee of the present application has previously addressed the issues noted above by providing a variable-nozzle turbocharger that includes a cartridge containing the variable vane mechanism. The turbine defines a nozzle through which exhaust gas is delivered to the turbine wheel, and a central bore through which exhaust gas is discharged after it passes through the turbine wheel. The cartridge is connected between the center housing and the turbine housing and comprises an assembly of a generally annular nozzle ring and an array of vanes circumferentially spaced about the nozzle ring and rotatably mounted to the nozzle ring and connected to a rotatable actuator ring such that rotation of the actuator ring rotates the vanes for regulating exhaust gas flow to the turbine wheel. The cartridge also includes an insert having a tubular portion sealingly received into the bore of the turbine housing and having a nozzle portion extending generally radially out from one end of the tubular portion, the nozzle portion being axially spaced from the nozzle ring such that the vanes extend between the nozzle ring and the nozzle portion. A plurality of spacers are connected between the nozzle portion of the insert and the nozzle ring for securing the nozzle ring to the insert and maintaining an axial spacing between the nozzle portion of the insert and the nozzle ring. The spacers are welded to the nozzle portion of the insert.

The task of welding the spacers to the nozzle portion of the insert is complicated by the fact that the holes for the spacers in the nozzle portion are close to the radially outer edge of the nozzle portion, and hence the local wall section between each hole and the outer edge of the nozzle portion is thin, whereas on the radially inner side of the hole there is much more metal mass. This large gradient in metal mass around the hole makes it difficult to form good welds with adequate weld penetration through the depth of the nozzle portion. Welding with greater intensity or longer duration to improve penetration is not a viable solution because of deleterious side effects such as degradation in flatness of the nozzle portion and excessive metal fusion at the outer edge of the nozzle portion where the wall section is thin.

Thus, while the above-described turbocharger functions well, further improvements are sought.

BRIEF SUMMARY OF THE DISCLOSURE

In accordance with one aspect of the present disclosure, in a turbocharger generally of the type described above, a variable-nozzle assembly comprises a generally annular nozzle ring and an array of vanes circumferentially spaced about the nozzle ring and rotatably mounted to the nozzle ring such that the vanes are variable in setting angle for regulating exhaust gas flow therethrough, and an insert having a tubular portion and having an annular nozzle portion extending generally radially out from one end of the tubular portion. The nozzle portion has a substantially planar first surface facing axially toward the nozzle ring and an opposite substantially planar second surface. The insert defines a plurality of axially extending holes extending entirely through a thickness of the nozzle portion defined between the first and second surfaces, the holes being spaced apart from one another along a circumferential direction of the nozzle portion and being proximate a radially outer edge of the nozzle portion. The assembly further comprises a plurality of spacers circumferentially spaced apart and having first ends joined to the nozzle ring, opposite second ends of the spacers engaged in the holes in the nozzle portion of the insert and secured to the nozzle portion by welds formed at the second surface. An annular groove is defined in the second surface of the nozzle portion and is located radially inward of and proximate to the holes, the groove extending partially through the thickness of the nozzle portion.

The provision of the groove in the nozzle portion is effective to reduce the mass of metal adjacent the radially inner side of each hole, so that the weld penetration achieved in this area is comparable to or at least closer to the degree of penetration achieved at the radially outer side of the hole near the outer edge of the nozzle portion.

In addition to or instead of the groove, for each hole the nozzle portion can have a pair of recesses defined in the second surface, the recesses being spaced on opposite sides of each hole. The recesses extend partially through the thickness of the nozzle portion. The recesses reduce the mass of metal adjacent the sides of the hole so as to facilitate greater weld penetration in these areas.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 4:
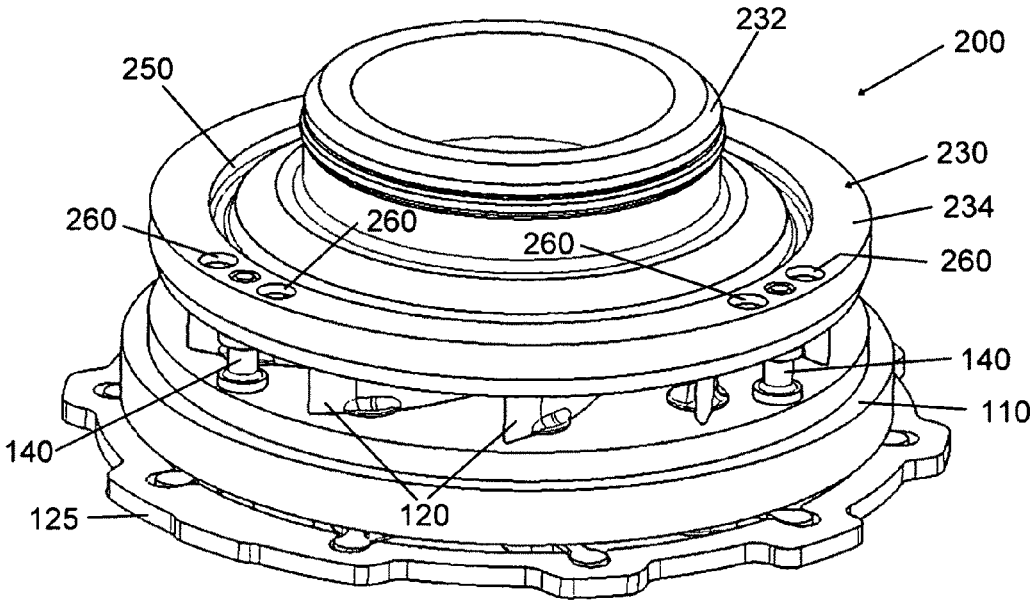
FIG. 4 is a perspective view of a variable-nozzle assembly in accordance with one embodiment of the invention.
Figure 6:
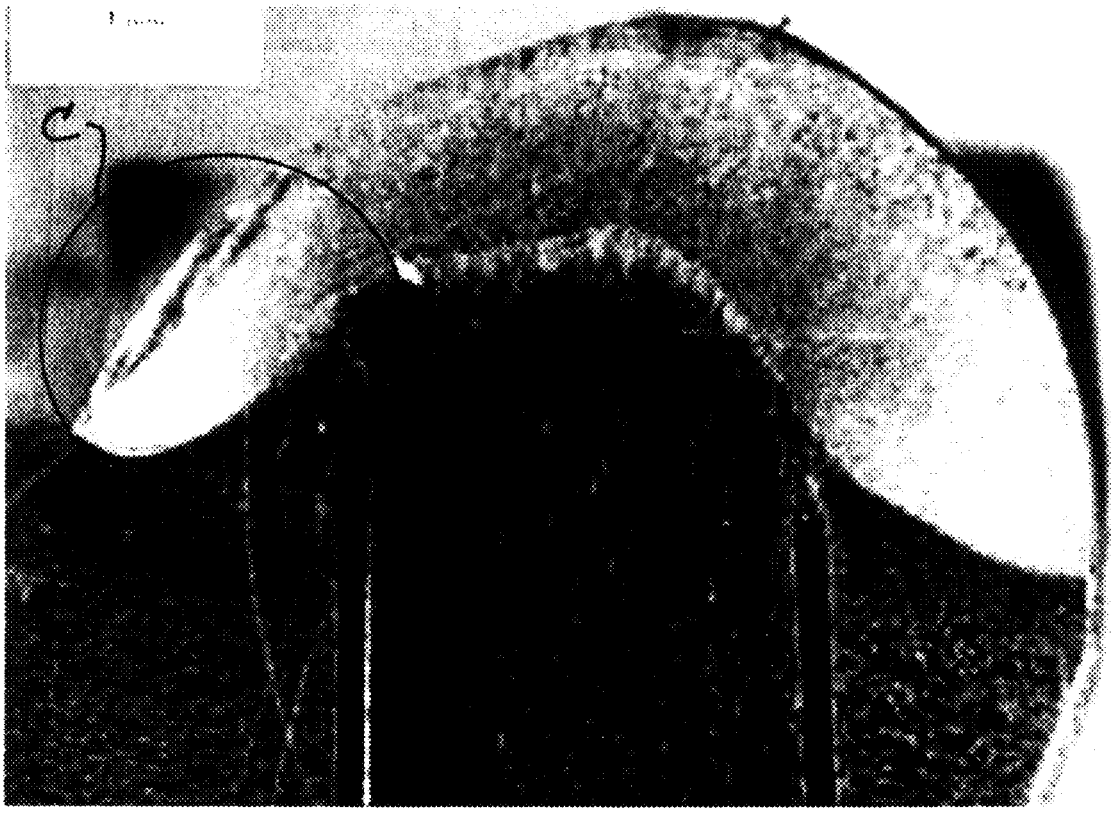
Figure 7:
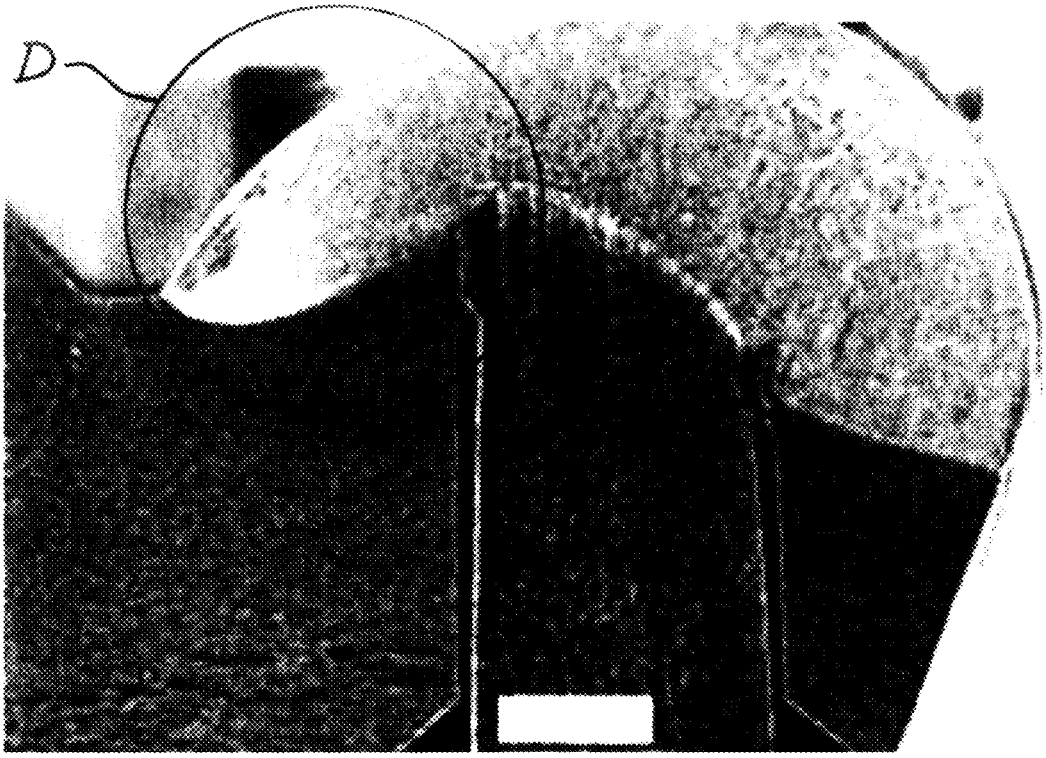

FIG. 6 is a magnified photograph of a weld produced in a variable-nozzle assembly having an annular groove in accordance with the invention, the weld being sectioned along a radial-axial plane of the assembly; and FIG. 7 is a magnified photograph of a weld produced in a variable-nozzle assembly having an annular groove plus two recesses generally as shown in FIG. 4, the weld being sectioned along a radial-axial plane of the assembly.

DETAILED DESCRIPTION OF THE INVENTION

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
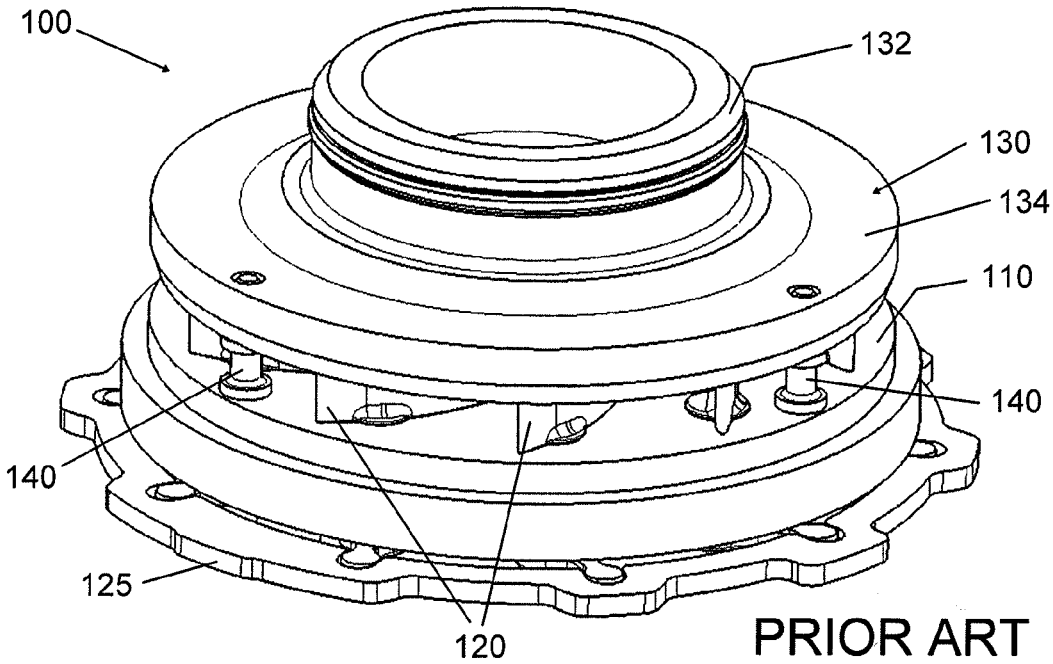
FIG. 1 is a perspective view of a variable-nozzle assembly that does not include the features of the present invention.
Figure 2:
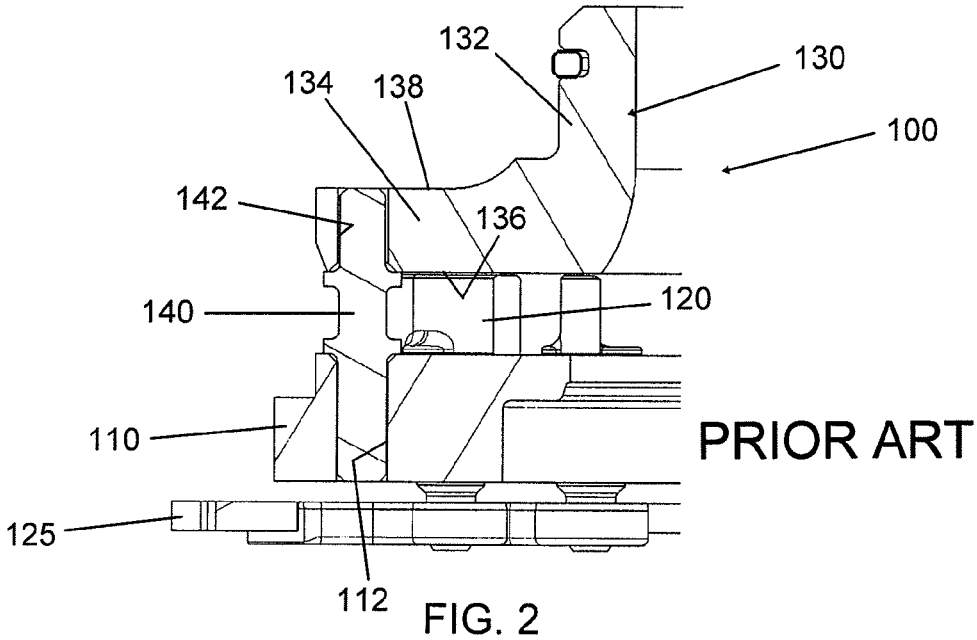
FIG. 2 is a cross-sectional view of a portion of the assembly of FIG. 1.

The present invention concerns an improvement to a variable-nozzle assembly 100 generally as shown in FIGS. 1 and 2. This variable-nozzle assembly is formed by a generally annular nozzle ring 110, which supports a plurality of vanes 120 circumferentially spaced about the nozzle ring. The vanes are rotatably journaled in the nozzle ring in known fashion so that the setting angles of the vanes can be varied for regulating flow through the nozzle. The variable-nozzle assembly further comprises an insert 130 having a tubular portion 132 configured to be inserted into an axial bore of a turbine housing. The insert also has an annular nozzle portion 134 joined to one end of the tubular portion 132 and extending radially outwardly therefrom. The nozzle portion has a substantially planar first surface 136 axially facing and spaced from the nozzle ring 110 and a substantially planar second surface 138 facing away from the nozzle ring. The vanes 120 are disposed between the nozzle ring and the nozzle portion of the insert. The vanes have vane arms (not visible) that are adjacent an opposite side of the nozzle ring from the insert, and the vane arms are engaged by a rotatable unison ring 125. Rotation of the unison ring pivots the vanes about their respective axes.

The nozzle portion 134 is secured to the nozzle ring 110 by a plurality of spacers 140 (three in number, in the illustrated embodiment) that are circumferentially spaced apart and that extend axially between the nozzle portion and nozzle ring. Each spacer has a middle portion of relatively greater diameter, and opposite first and second end portions that are smaller in diameter than the middle portion and are cylindrical in form. The first end portion is secured in any suitable fashion in a hole 112 formed in the nozzle ring, and the second end portion passes through a hole 142 formed in the nozzle portion 134. The holes 112, 142 are smaller in diameter than the middle portion of the spacer, such that the middle portion abuts the facing surfaces of the nozzle ring and nozzle portion and keeps them spaced by an axial distance dictated by the middle portion of the spacer. The second end portion of the spacer has a length about equal to the thickness of the nozzle portion 134 such that the tip of the spacer is approximately flush with the second surface 138. The second end portion of the spacer is secured to the nozzle portion by a weld made at the second surface.

Figure 3:
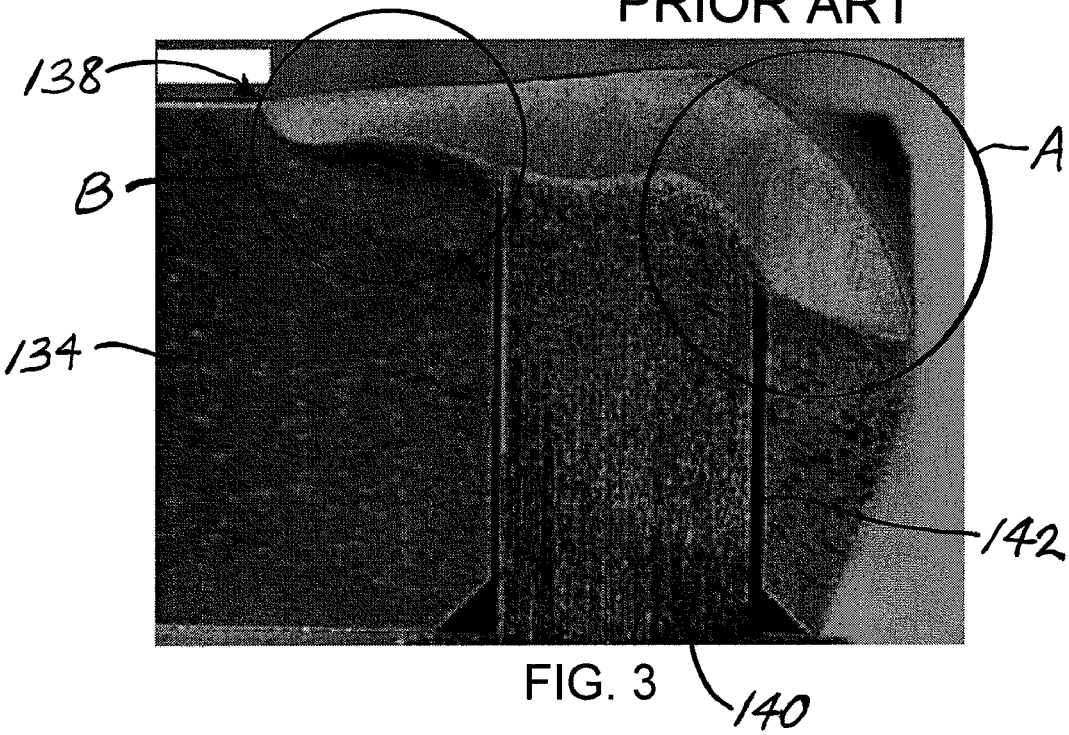
FIG. 3 is a magnified photograph of a weld produced in a variable-nozzle assembly generally as shown in FIG. 1, the weld being sectioned along a radial-axial plane of the assembly.

A weld was produced in this manner and thereafter was sectioned along a radial-axial plane and photographed. The weld was produced by a PTW 150 plasma arc torch supplied by L-TEC SchweiBtechnik GmbH of Wissen, Germany. The weld temperature was about 1600 to 2000° C., and the weld process was an autogenous process (i.e., there was no added weld material). The spacer 140 was made of AISI316L (an austenitic stainless steel) and was manufactured by turning, and the insert 130 was made of AISI309 (an austenitic stainless steel) and was manufactured by hot forging and machining. An enlarged photograph of the sectioned weld is shown in FIG. 3. It can be seen that at the radially outer side of the hole 142 (indicated as region A in FIG. 3) where the amount of metal thickness in the radial direction is small because of the proximity of the hole to the outer edge of the nozzle portion 134, the penetration of the weld in the thickness direction of the nozzle portion is relatively large. In contrast, at the radially inner side of the hole (indicated as region B in FIG. 3), where the mass of metal is much greater, the weld penetration is substantially smaller. This non-uniform penetration is undesirable, and the present invention is aimed at reducing the non-uniformity.

Figure 5:
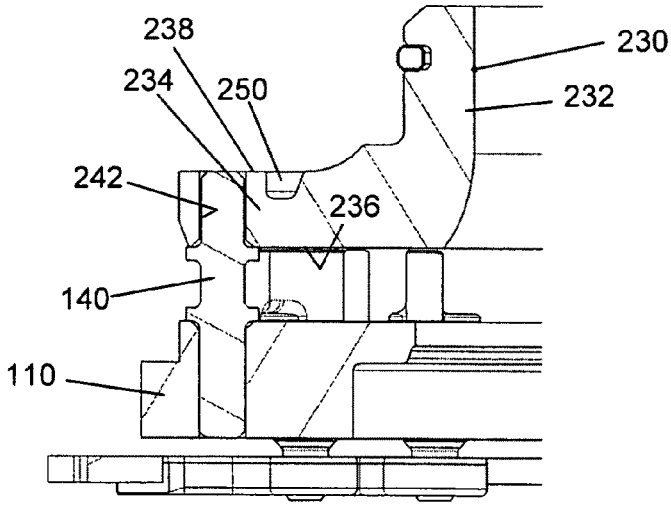
FIG. 5 is a cross-sectional view of a portion of the assembly of FIG. 4.

Accordingly, a variable-nozzle assembly 200 in accordance with one embodiment of the invention is shown in FIGS. 4 and 5. The assembly includes the same nozzle ring 110, vanes 120, and spacers 140 as in the FIG. 1 embodiment, and thus the descriptions of these parts are not repeated here. The assembly 200 differs from the prior assembly in that the insert 230 is modified relative to the insert 130. The insert 230 includes a tubular portion 232 generally as previously described. The nozzle portion 234 of the insert still has the substantially planar first surface 236 and substantially planar second surface 238, and includes holes 242 for the second end portions of the spacers 140. However, unlike the prior embodiment, the second surface 238 has an annular groove 250 formed therein, extending partially through the thickness of the nozzle portion 234. The groove is located just radially inwardly of the holes 242. A radial distance between the radially inner edges of the holes 242 and the radially outer edge of the groove 250 can be approximately equal to the radial distance between the radially outer edges of the holes 242 and the radially outer edge of the nozzle portion. Generally, this spacing distance can be about 0.3 to 0.7 times the diameter of the holes 242, although the invention is not limited in this sense. The radial width of the groove 250 can be about 0.5 to 1.0 times the diameter of the holes 242, although again the invention is not limited in this way.

In addition to, or instead of, the annular groove 250, the second surface 238 of the nozzle portion 234 can also include a pair of recesses 260 associated with each hole 242. The recesses 260 are spaced on opposite sides of each hole 242 in the circumferential direction, and extend partially through the thickness of the nozzle portion. Each of the recesses can be spaced from the associated hole 242 by a circumferential distance about equal to the radial distance between the radially outer edges of the holes 242 and the radially outer edge of the nozzle portion. Generally, this circumferential distance can be about 0.3 to 0.7 times the diameter of the holes 242, although the invention is not limited in this sense. The recesses can be circular and can have a diameter equal to about 0.8 to 1.3 times the diameter of the holes, although again the invention is not limited in this way. The recesses 260 are effective to reduce the mass of metal adjacent the circumferentially opposite sides of the holes 242, and thereby facilitate greater weld penetration in these areas.

A weld produced between a spacer and a nozzle portion having an annular groove 250 but lacking recesses 260 was sectioned along a radial-axial plane and photographed. A magnified photograph of the weld is shown in FIG. 6. At the radially outer side of the hole, the weld penetration again is relatively great. At the radially inner side of the hole (designated as region C in FIG. 6), the weld penetration is not quite as great, but is substantially larger than for region B of the weld shown in FIG. 3. At the circumferentially opposite sides of the hole (not shown), the penetration was similar to region B in FIG. 3.

To test the effect of the recesses 260, a weld produced between a spacer and a nozzle portion having both the annular groove 250 and the recesses 260 generally as shown in FIG. 4 was sectioned along a radial-axial plane and photographed. A magnified photograph of the weld is shown in FIG. 7. At the radially outer side of the hole, the weld penetration again is relatively great. At the radially inner side of the hole (designated as region D in FIG. 7), the weld penetration is not quite as great, but is substantially larger than for region B of the weld shown in FIG. 3. At the circumferentially opposite sides of the hole (not shown), the penetration was similar to region D. Thus, the recesses 260 increased the weld penetration at the circumferentially opposite sides of the hole.

The annular groove 250 and/or recesses 260 thus are effective for increasing the weld penetration in the regions adjacent thereto.

It is also within the scope of the invention to employ three recesses per hole and no groove. Two of the recesses are on opposite circumferential sides of a hole, and the third recess is on the radially inner side of the hole.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A variable-nozzle assembly for a turbocharger, comprising:

a generally annular nozzle ring and an array of vanes circumferentially spaced about the nozzle ring and rotatably mounted to the nozzle ring such that the vanes are variable in setting angle for regulating exhaust gas flow therethrough;

an insert having a tubular portion and having an annular nozzle portion extending generally radially out from one end of the tubular portion, the nozzle portion having a substantially planar first surface facing axially toward the nozzle ring and an opposite substantially planar second surface, the insert defining a plurality of axially extending holes extending entirely through a thickness of the nozzle portion defined between the first and second surfaces, the holes being spaced apart from one another along a circumferential direction of the nozzle portion and being proximate a radially outer edge of the nozzle portion;

a plurality of spacers circumferentially spaced apart and having first ends joined to the nozzle ring, opposite second ends of the spacers engaged in the holes in the nozzle portion of the insert and secured to the nozzle portion by welds formed at the second surface; and an annular groove defined in the second surface of the nozzle portion and located radially inward of and proximate to the holes, the groove extending partially through the thickness of the nozzle portion.

2. The variable-nozzle assembly of claim 1, wherein a radial width of the groove is constant along the circumferential direction.

3. The variable-nozzle assembly of claim 1, wherein a maximum radial width of the groove is equal to about 0.5 to 1.0 times the diameter of the holes.

4. The variable-nozzle assembly of claim 1, wherein the groove is spaced from the holes by a radial distance equal to about 0.3 to 0.7 times the diameter of the holes.

5. The variable-nozzle assembly of claim 1, further comprising a pair of discrete recesses for each hole, each pair of recesses being formed in the second surface of the nozzle portion and the recesses of each pair being spaced on opposite sides of the respective hole generally in the circumferential direction, the recesses extending partially through the thickness of the nozzle portion.

6. The variable-nozzle assembly of claim 5, wherein the recesses are circular.

7. The variable-nozzle assembly of claim 6, wherein the recesses have a diameter equal to about 0.8 to 1.3 times the diameter of the holes.

8. A variable-nozzle assembly for a turbocharger, comprising:

a generally annular nozzle ring and an array of vanes circumferentially spaced about the nozzle ring and rotatably mounted to the nozzle ring such that the vanes are variable in setting angle for regulating exhaust gas flow therethrough;

an insert having a tubular portion and having an annular nozzle portion extending generally radially out from one end of the tubular portion, the nozzle portion having a substantially planar first surface facing axially toward the nozzle ring and an opposite substantially planar second surface, the insert defining a plurality of axially extending holes extending entirely through a thickness of the nozzle portion defined between the first and second surfaces, the holes being spaced apart from one another along a circumferential direction of the nozzle portion and being proximate a radially outer edge of the nozzle portion;

a plurality of spacers circumferentially spaced apart and having first ends joined to the nozzle ring, opposite second ends of the spacers engaged in the holes in the nozzle portion of the insert and secured to the nozzle portion by welds formed at the second surface; and a pair of discrete recesses for each hole, each pair of recesses being formed in the second surface of the nozzle portion and the recesses of each pair being proximate to sides of the respective hole, the recesses extending partially through the thickness of the nozzle portion.

9. The variable-nozzle assembly of claim 8, wherein the recesses of each pair are spaced on opposite sides of the respective hole generally in the circumferential direction.

10. The variable-nozzle assembly of claim 8, wherein the recesses are circular and have a diameter equal to about 0.8 to 1.3 times the diameter of the holes.

* * * * *